US005566738A

United States Patent [19]

Yadidya

[11] Patent Number: 5,566,738

[45] Date of Patent: Oct. 22, 1996

[54] LOUVERED MOVABLE WINDOW SHUTTER

[76] Inventor: Hagay Yadidya, 21 Klausner Street, Kiryat-Ata, Israel

[21] Appl. No.: 434,790

[22] Filed: May 4, 1995

[30] Foreign Application Priority Data

May 15, 1994 [IL] Israel ..... 109652

[51] Int. Cl.[6] ..... E06B 9/08; E06B 9/30; E05D 15/06

[52] U.S. Cl. ..... 160/133; 160/172; 160/201; 160/235; 49/74.1; 49/92.1

[58] Field of Search ..... 160/133, 201, 160/172 R, 235, 165, 168, 176; 49/74.1, 92.1

[56] References Cited

U.S. PATENT DOCUMENTS

| | | | |
|---|---|---|---|
| 3,120,035 | 2/1964 | Morris | 49/92.1 X |
| 3,219,104 | 11/1965 | Walker | 49/74.1 X |
| 3,302,692 | 2/1967 | Grau . | |
| 3,516,470 | 6/1970 | Kurz | 160/172 R |
| 3,578,060 | 5/1971 | Spencer | 160/172 R |
| 3,651,852 | 3/1972 | Neri | 160/172 R |
| 4,715,421 | 12/1987 | Erber . | |

*Primary Examiner*—Blair Johnson
*Assistant Examiner*—Bruce A. Lev
*Attorney, Agent, or Firm*—Frishauf, Holtz, Goodman, Langer & Chick

[57] ABSTRACT

A roller shutter includes a plurality of horizontal slats (I) each provided with a flat lug (22) projecting from each end and mounting inside guide rails (V) on both sides of the window or door. Each slat has its upper edge (3) bent in a hook-profile in one direction and its lower edge (4) bent in a hook-profile in the opposite direction. The upper edge of each slat engages the lower edge of the adjoining slat in such a manner that all slats of the shutter are in firm engagement wile their axes are at a possible maximum distance from each other, but are releasable from each other by their rotation about their axes whenever the shutter is lowered with the lowermost slat resting on the window sill with the slat axes at a minimum distance from each other. Rotation of the slats is carried out by slotted rotors (III) rotatably mounted in the guide rails (V) whereof each rotor slot engages one flat lug (22), at minimum distance. All rotors on either side are simultaneously rotated about a desired angle by lever means (33), thereby disengaging the respective slat edges and holding the slats in angular position.

19 Claims, 8 Drawing Sheets

LOUVERED MOVABLE WINDOW SHUTTER

The invention relates to a window shutter, particularly to a movable roller shutter with horizontal, louverable slats.

BACKGROUND OF THE INVENTION

Modern window shutters, especially roller shutters, consist of a plurality of horizontal slats which are flexibly interconnected along their adjoining edges allowing raising the shutter by winding it up on a horizontal shaft mounted above the window opening. These shutters are lowered to protect the room against unauthorized entry and to darken the room at night, and are raised during daytime to let in air and light, but do not protect the room. Now there is the wish of most people to allow air and light to enter the room, with the shutter down, whereby the room is protected against entry, but is still more or less fully lighted and aired. The last part of this task is effected by the so-called venetian blind having overlapping horizontal slats which may be raised and drawn together above the window by pulling a cord, and which in lowered position may be louvered into parallel alignment. Their drawback is that the slats are of a thin and pliable material which do not protect the room and the window against forceful entry.

On the other hand, roller shutters have been designed with solid slats having their both ends pivotally held in two chains and being provided with cords attached to their outer edges which permit their turning about these pivots into horizontal, louvered state. Their main drawback is the fact that each slat is separately bendable and easily pushed aside for entry into the room, for the reason that the slats are not interconnected along their common edges as in the conventional shutter, and that the louvering mechanism is complicated.

It is, therefore, a foremost object of the invention to provide a roller shutter which will serve as safe protection against entry in lowered position, while simultaneously allowing light and air to enter the room with the slats louvered.

It is another object of the invention to provide a roller shutter of simple construction making its operation easy and simple.

And it is a final object to provide shutters of this kind at low cost to allow their installation in every dwelling.

SUMMARY OF THE INVENTION

A preferred embodiment of the roller shutter according to the present invention comprises a plurality of solid slats which are flexibly interconnected along their adjoining edges in wound up or raised state, and which are automatically separated from each other into separate components, in completely lowered state, thus permitting turning of each slat about its horizontal axis into louvered alignment of all slats of one shutter. In particular, each slat includes alternately bent edges of hook-shaped cross section which engage with the respective hook-shaped edge of the adjoining upper and lower slat and hold all slats in firm connection while the shutter is in raised or wound-up state and their axes are at a maximum distance from each other, but which permit rotation of each slat out of engagement of adjoining edges, as soon as the bottom slat is in its lowermost position and the distance between the axes of adjoining slats is thereby reduced to a minimum, by means of stops on each slat defining this distance. The slats are guided in parallel, preferably channel-shaped, guide rails mounted to both sides of the window—or door—opening and in the vertically positioned slots of rotors which are horizontally and rotatably mounted in the guide rails at a distance coextensive with the "minimum" distance between the slats. Each slat is provided at its two ends with sideways protruding flat lugs, each engaging with a slot in the corresponding rotor as soon as the shutter has been lowered into its lowermost position, whereafter simultaneous angular displacement of all rotors and slats effects mutual disengagement of the hook-shaped edges of the slats and rotation of all slats into louvered position. In this position every slat is firmly held in its respective rotors on both sides by a rim surrounding each rotor and the lug positioned in the rotor slot, preventing its forceful removal.

In a preferred embodiment of the shutter the slats are made of extruded aluminum or plastic and are shorter than the distance between the guide rails. A short lateral member is attached to each outer end, as for instance by means of a screw, which extends into the guide rail on each side. Each lateral member includes a main portion of similar cross section as that of the slat to which it is attached, and is continued sideways by the afore mentioned flat lug intended for engagement with the slot in each rotor. Each lateral member is connected to the member of the slat above and below by hook-shaped connectors which are alternately hammer-shaped and centrally slotted, whereby the handle of the hammer engages with the slot in the adjoining lateral member preventing independent sideways movement of each separate slat at the time the shutter is wound up on the upper shaft. As soon as the shutter is down in its lowermost position the connectors are disengageable at the same time as the slats are separated from each other.

The rotors are provided with sideways extending levers which extend through slots in the guide rails, each lever being at its outer end pivotally attached to a common bar which is configured to rotate all rotors about the same angle by being pushed in upward or downward direction. The rims surrounding the rotors are preferably in the shape of blocks firmly mounted inside the guide rail between each pair of rotors and having at both their upper and their lower ends a circular cut-out surrounding about 30% of the rotor circumference, whereby each two blocks surround about 60% of the rotor circumference.

In a second embodiment of the roller shutter almost all components are identical with those described in connection with the first embodiment with the exception of the lateral members attached to both ends of the slats. In the present embodiment each flat lug is attached to one end of a slat by means of a bolt at a distance from the end of the slat co-extensive with the width of a lateral member. Each lateral member is centrally perforated by a bore coextensive with the diameter of the bolt and is rotatably mounted on this bolt between slat end and lug. Adjoining lateral members are linked by connectors which are alternately hammer-shaped and hook-shaped, with the difference that they do not separate together with the slats but remain linked while the slats are turned about the desired angle by means of the rotors and the flat lugs and thus separated from each other.

DETAILED DESCRIPTION OF THE DRAWINGS

Figure 1A:
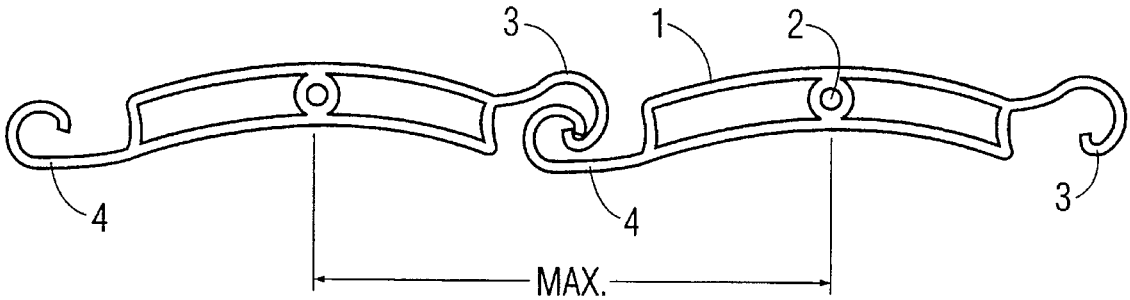
FIG. 1, A,B,C, is a vertical section of the screen, showing two slats in three different positions of the shutter.
Figure 1B:
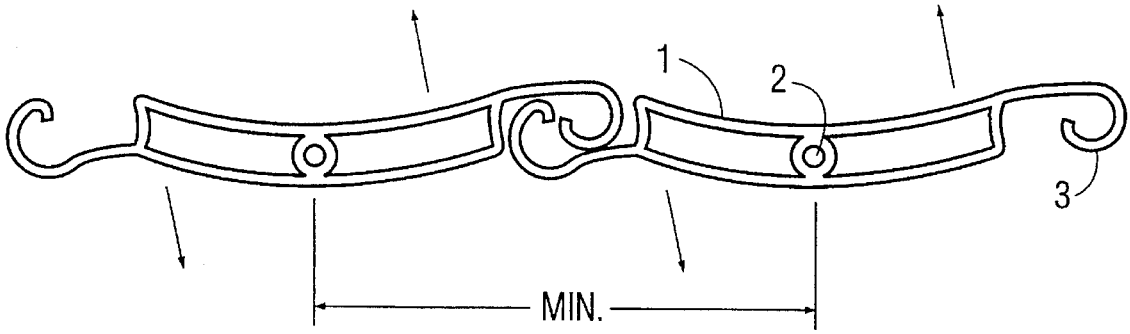
Figure 1C:
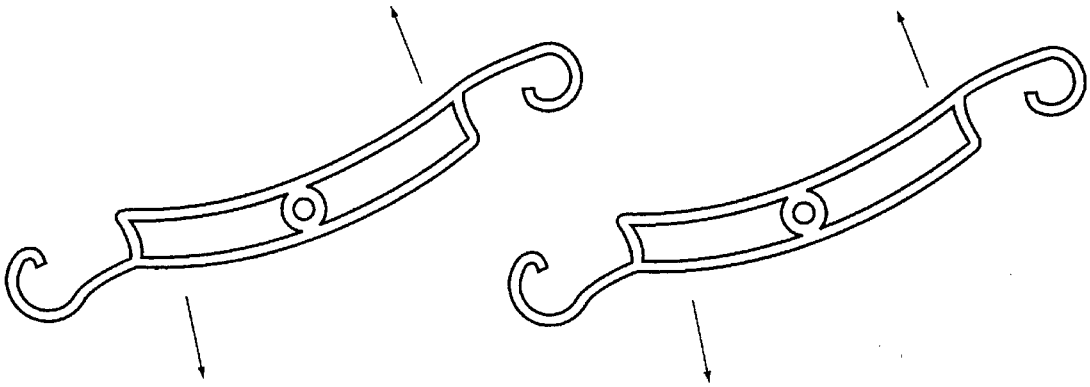

FIG. 1A shows two adjoining slats in three different positions, wherein each slat includes the following portions: a main portion 1 which is hollow and slightly bent to give it stiffness, a through-going hole 2 for screwed connection of the lateral members, a top edge 3 bent into hook-shape and a bottom edge 4 bent into an opposite hook-shape. As seen in FIG. 1A the two slats are at their maximum distance MAX with their hook-shaped edges interengaging along the entire length of the slats. This is the state of the shutter before the lowermost slat reaches the bottom of the window or the door, and makes the shutter strong enough to prevent unlawful entry. FIG. 1B shows the two slats at their minimum distance MIN, caused by releasing the shutter from the upper shaft and position of the lowermost slats on the bottom of the window or door. It can be clearly seen that the hook-shaped edges are free from engagement and can be loosened from each other by slightly rotating the two slats in the direction of the arrows. This rotation leaves every slat free and disconnected from its neighbour, as can be seen in FIG. 1C.

Figure 2:
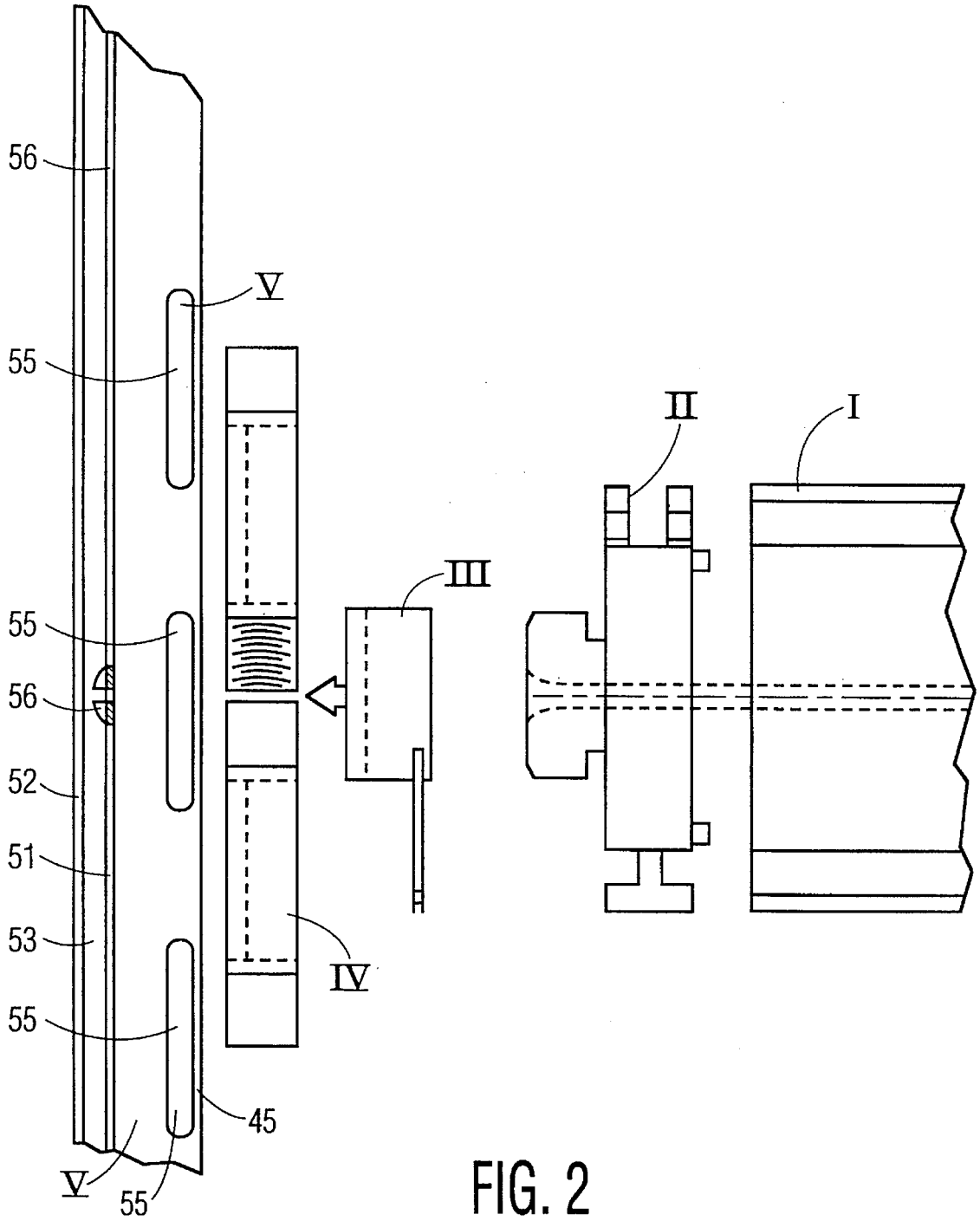
FIG. 2 is an exploded view of the components of one slat and its louvering mechanism.

FIG. 2 illustrates the different components of one end of a slat and its louvering mechanism which include, starting from the right side of the drawing:—the slat I, the lateral member II, the rotor III, the blocks IV and the guide rail V. Their details will now be described with reference to FIGS. 3 through 9 of the drawings, except for the shape of slat I which has been described with reference to FIG. 1. The lateral member II consists of a main body 20 shaped in accordance with that of the slat and has two lugs 21 protruding sideways for connection to the slat by inserting these lugs into the hollow interior of the slat. A large, flat lug 22 protrudes out of the other side for engagement with the slot in the rotor and for guidance of the slat along slots in the blocks, (shown in FIGS. 3 through 9. The body and lug 22 are perforated by a bore 23 for screwed connection of the member to the slat. The upper and the lower end of the member are extended in the form of hooks, an upper hook 24 of a width coextensive with that of body 20 connected thereto by a stay 25, and two lower hooks 26 separated by a gap 27 of a width permitting the entry of stay 25.

The rotor III consists of a cylindrical body 30 which is centrally slotted by a slot 31 of a width larger than that of lug 22 of the lateral member. A pin 32 protrudes out of the side opposite the slot in central alignment with the body and serves as axle for the rotating of the rotor. A lever 33 is axially attached to the body and serves for rotation of the rotor. The block IV is of a length shorter than the distance between two rotor centers and is of rectangular cross section. It is slotted by a longitudinal slot 40 and has its two ends recessed by quarter-circular cut-outs 41 of a diameter somewhat larger than that of the rotor. A countersunk bore 42 in the slot serves for screwed attachment to the guide rail.

Figure 3:
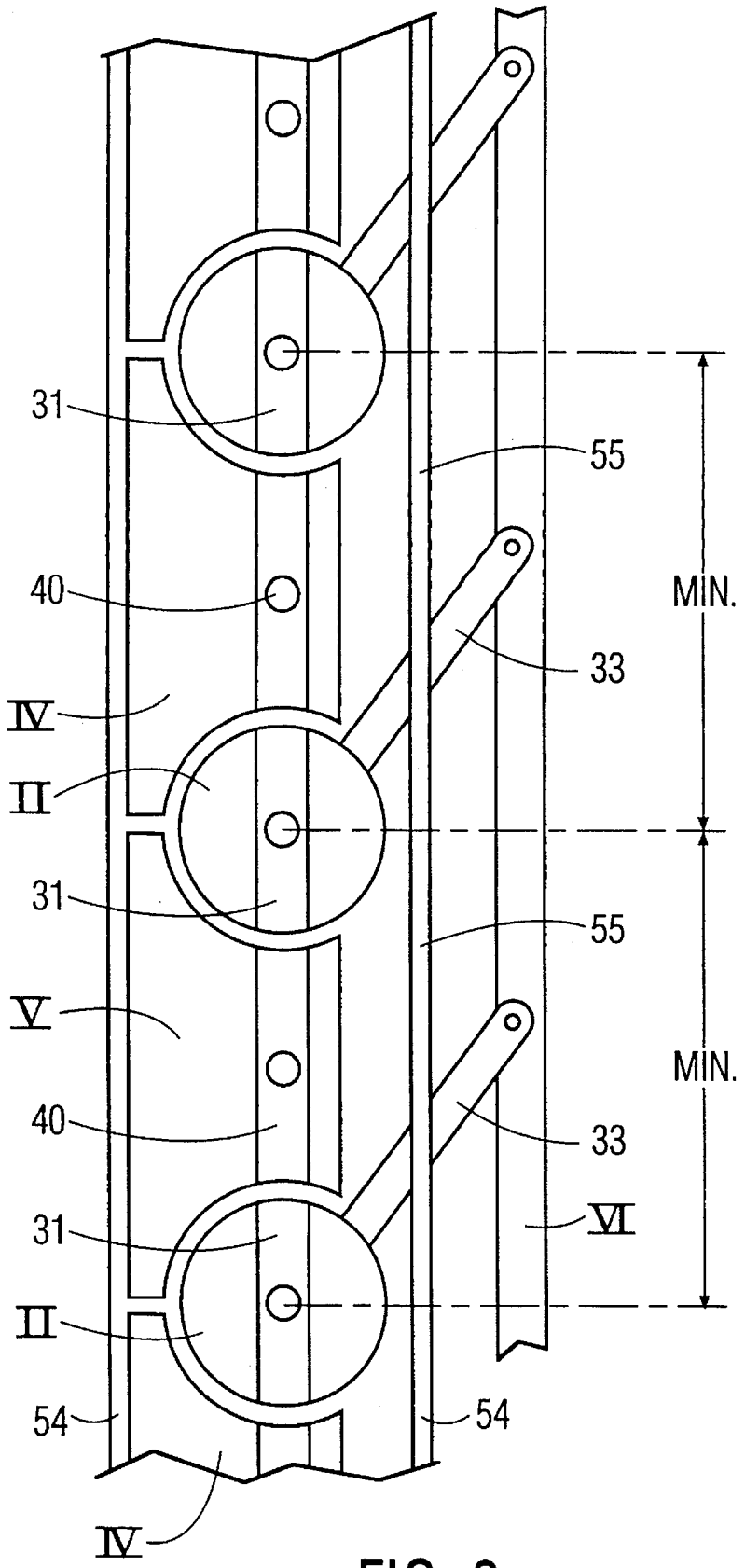
FIG. 3 is a view of part of one guide rail while the shutter is raised above the shown portion.
Figure 4:
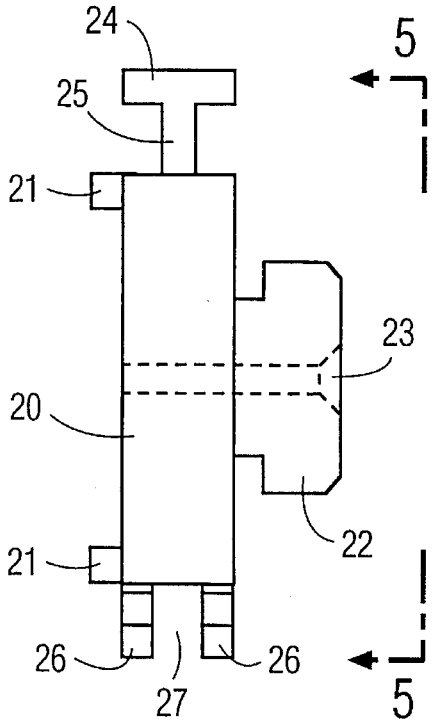
FIG. 4 is an elevation of a lateral member.
Figure 5:
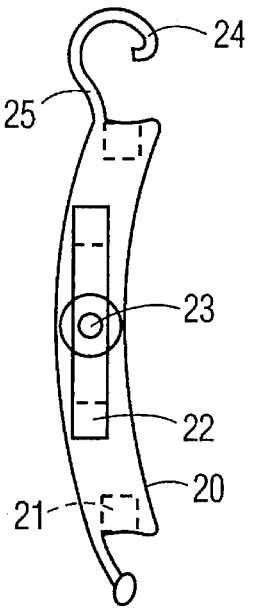
FIG. 5 is side view of the member of FIG. 4 along line 5—5.
Figure 6:
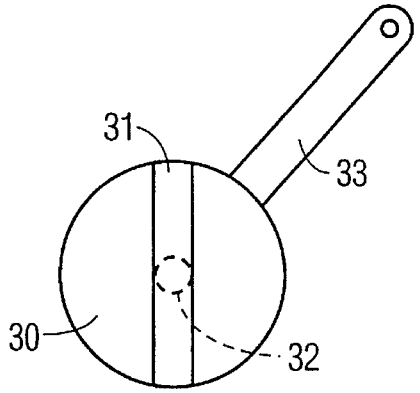
FIG. 6 is a side view of a rotor.
Figure 8:
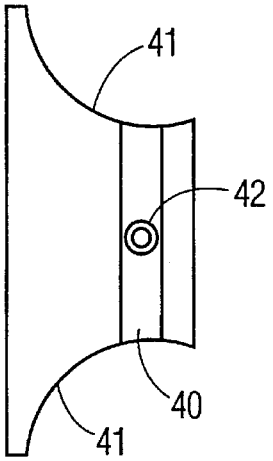
FIG. 8 is a side view of a block.
Figure 7:
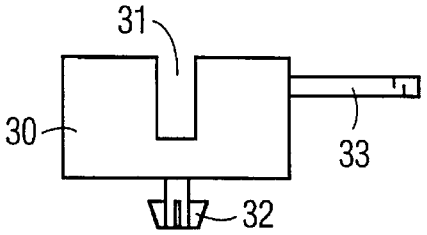
FIG. 7 is a top view of the rotor of FIG. 6.
Figure 9:
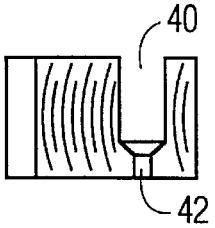
FIG. 9 is a top view of the block of FIG. 8.

The guide rail will be described with reference to FIGS. 2 and 3. It is in channel shape with a double bottom 51 and 52 forming a space 53 therebetween. Bottom 51 is perforated by bores 56. Two flanges 54 extend from the bottom, one of them being perforated by slots 55 for accommodation of the lever 33 of the rotors. The assembly of four blocks and three rotors is shown in FIG. 3. It should be noted that the slots 31 in the rotors and slots 40 in the blocks form a continuous channel for accommodation of the lugs 22 of the lateral members enabling smooth lowering and raising of the shutter. The rotors are rotationally fastened to the guide rail by means of pins 32 passing through bores 56 into space 53. Levers 33 extend through slots 55 in flange 54 to the outside where they are pivotally attached to a vertical bar VI serving for simultaneous rotation of all rotors in the guide rail.

Figure 10:
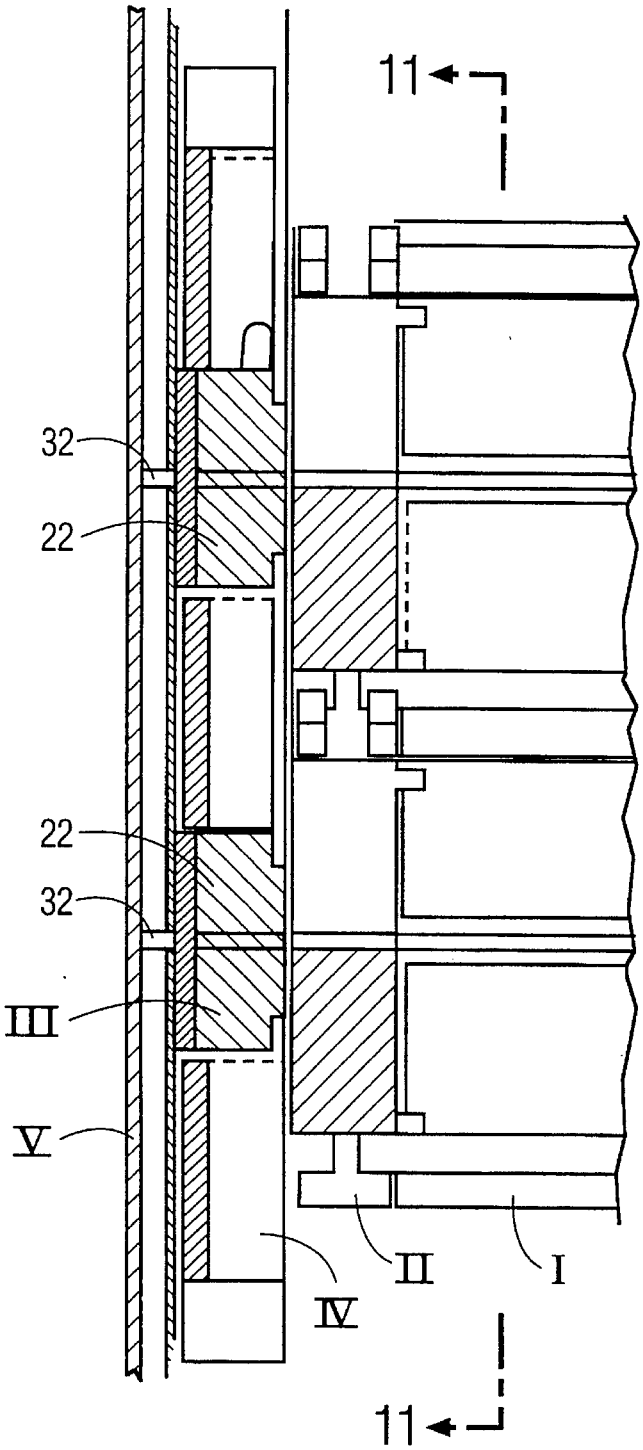
FIG. 10 is a vertical section through a portion of the shutter in closed position and through the louvering mechanism positioned in the guide rail.
Figure 11:
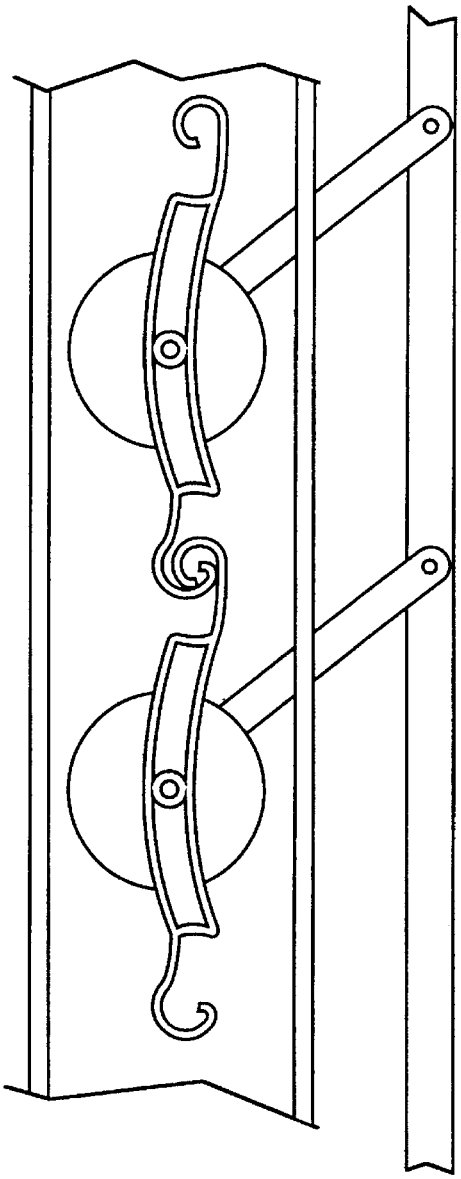
FIG. 11 is a section along line 11—11 of FIG. 10.

A portion of the shutter in closed state is illustrated in FIGS. 10 and 11, wherein all components are indicated by their Roman numerals. The section through the two slats I of FIG. 11 shows that they have reached their minimum distance and can be separated by mutual rotation, as the shutter has been lowered into its lowermost position which is not shown. The fixation of rotors III by means of pins is clearly visible which permits their rotation by the external bar VI into any angular alignment. The blocks IV surround the rotors in such a manner that lugs 22 cannot escape out of the rotor slots 32, preventing any removal of one or more slats for illegal entry into a room.

Figure 12:
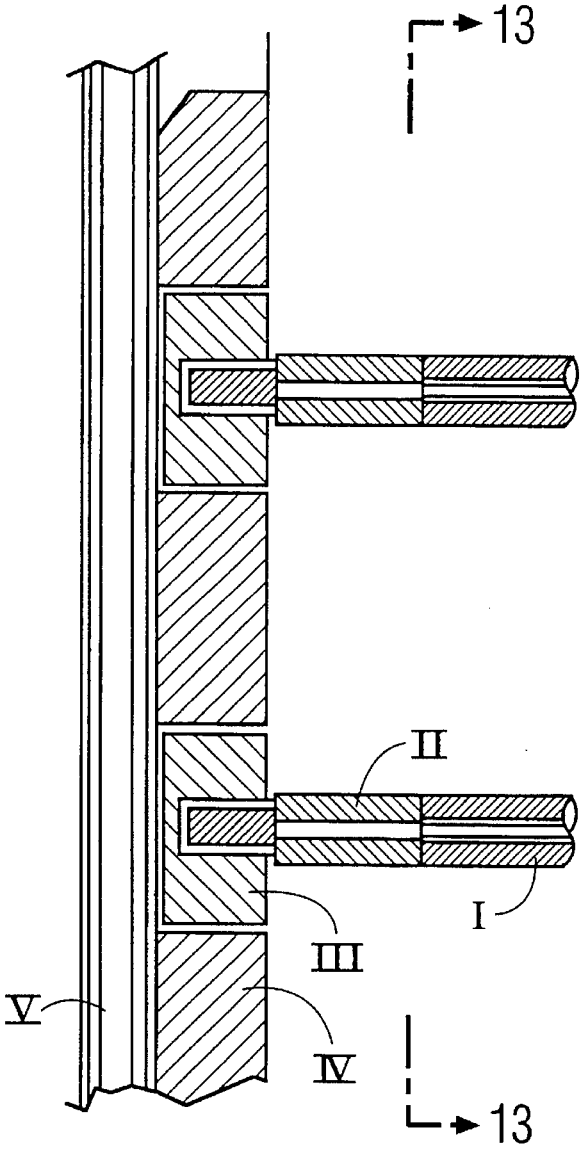
FIG. 12 is a vertical section through a portion of the shutter in louvered position and through the louvering mechanism positioned in the guide rail.
Figure 13:
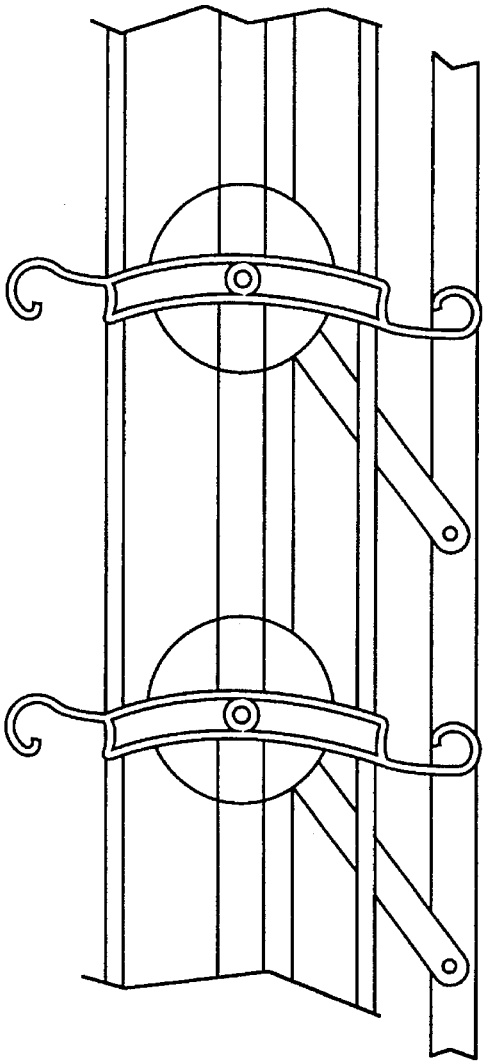
FIG. 13 is a section along line 13—13 of FIG. 12.

FIGS. 12 and 13 show the portion of the shutter illustrated in FIGS. 10 and 11, with the slats turned about a right angle into horizontal, parallel alignment, but it will be understood that any other angle can be produced in accordance with the position of the sun, the amount of light to be allowed to enter and the like.

In order to close the shutter and to make it safe, the slats are brought back into vertical alignment as shown in FIG. 10 and are raised until their hook-shaped edges interlock firmly. In this position the shutter can be raised and wound up on its shaft above the door or window leaving the latter completely open.

It will be understood that the shutter as illustrated and described in the foregoing constitutes only one example of the possible variations and modifications which could be carried out by a person skilled in the art. For instance, instead of having the edges of the entire slats inter-engaging by means of their hook-shaped edges, it is proposed to have the slats I slightly overlap while only the hooks on the lateral members interengage.

The rotors are not necessarily cylindrical, but could be in the form of a channel-shaped block including a pin for rotational fixation and a lever.

As an alternative, the lateral members could be omitted altogether, while each slat would be provided with a laterally outstanding lug at each end for engagement with the slots in the blocks and the rotors.

Figure 14:
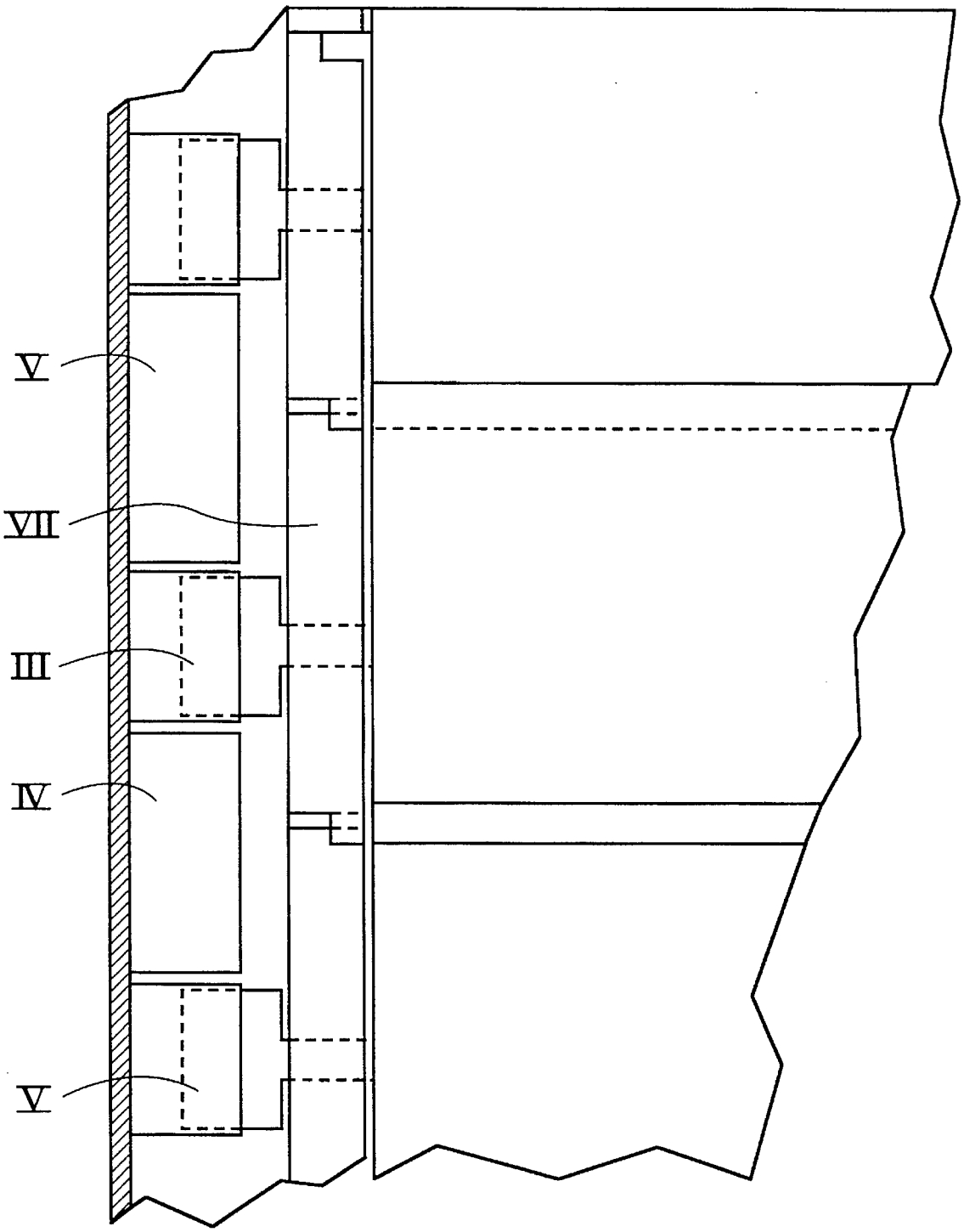
FIG. 14 is a side view of a portion of the roller shutter according to the second embodiment.
Figure 15:
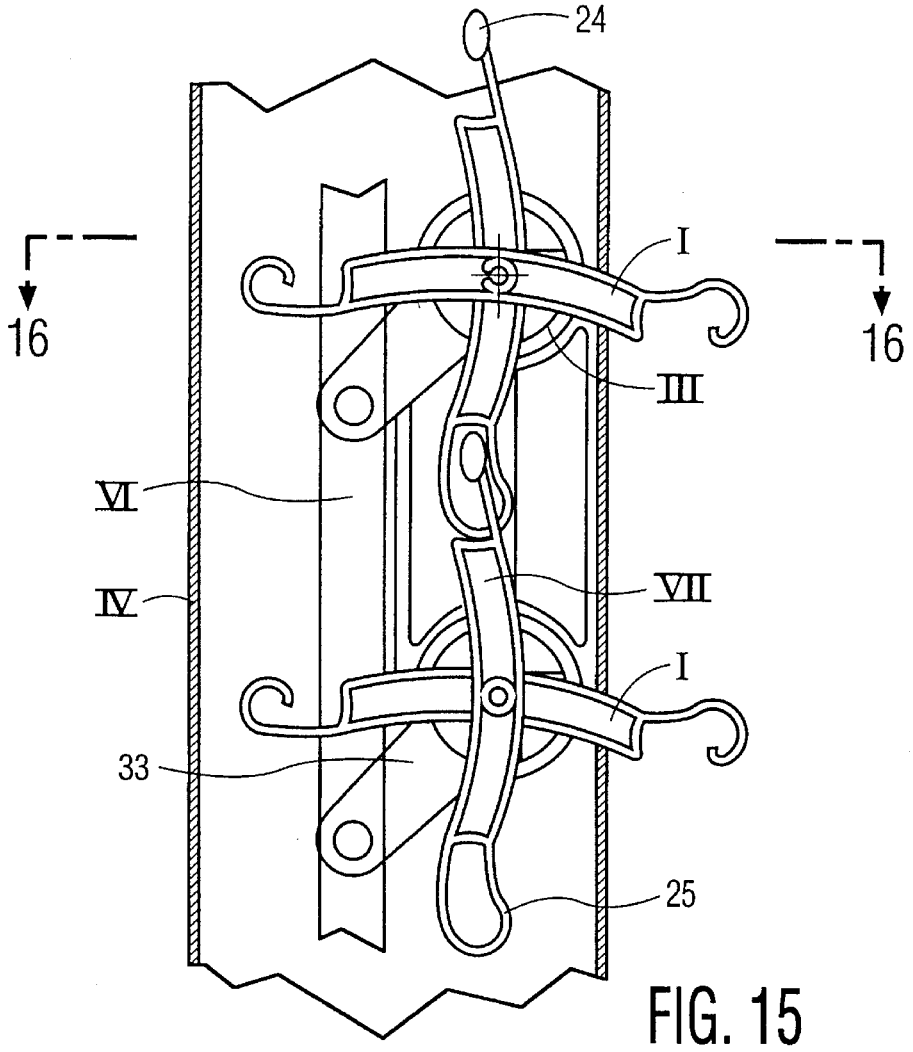
FIG. 15 is a vertical section of a portion of a second embodiment of the roller shutter on; louvered position, showing two slats in section and a side view of two lateral members.
Figure 16:
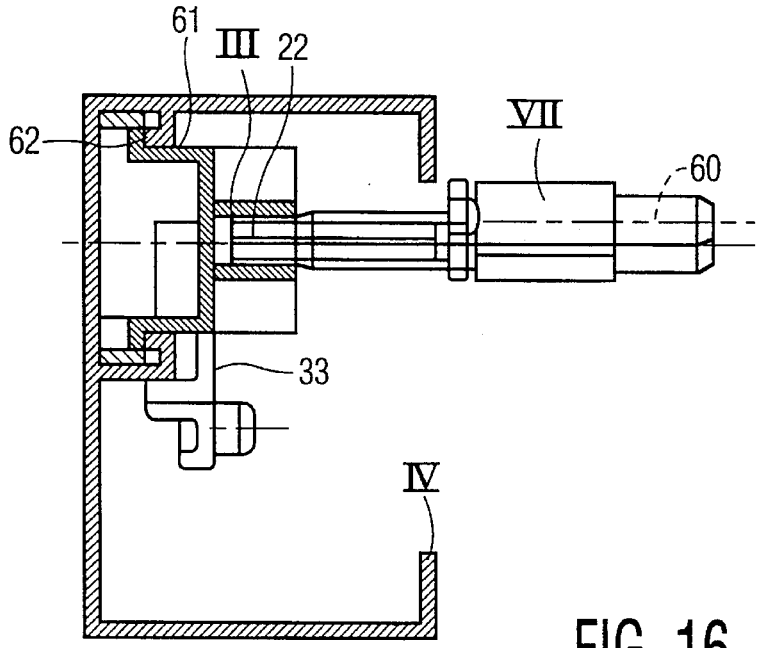
FIG. 16 is a section along line 16—16 of FIG. 15.

The embodiment of the shutter illustrated in FIGS. 14, 15 and 16 differs mainly from the first embodiment in that the lateral members (VII) are not rotated together with the slats I, but are rotatably mounted on bolts 60. Bolts 60 carry flat lugs 22 at their outer ends and are rigidly connected to openings in slats I at their other ends. The lateral members are of a cross section identical with that of the slats and are permanently linked to each other by means of hammer-shaped connectors 24 at the upper end of each member engaging loop-shaped connectors 25 at the lower end of the adjoining member, similar, but not releasably, to the connection of the members of the first embodiment.

As illustrated in FIGS. 15 and 16, both the guide rail IV and the rotors III differ slightly in design from their counterparts of the first embodiment; —each rotor III includes a rearward extending drum-shaped portion 61 which engages with a ridge shaped pocket 62 provided in the guide rail. In these pockets the rotors are rotatable into louvered position by a bar VI and by levers 33 pivotally connected thereto. The guide rail IV as shown in FIG. 16 is of greater width than that of the first embodiment permitting the bar IV to be located inside the rail instead of the outside, for esthetic reasons. As illustrated in FIG. 15, the lateral members remain interconnected while the slats are separated from each other by disengagement of their hook-shaped upper and lower edges. In all other respects, particulalrly in regard to their operation, the two embodiments are alike.

I claim:

1. A roller shutter designed for louvering purposes, in combination with guide rails adapted to be mounted on sides of an opening and a rotatable shaft adapted to be mounted on top of said opening, said shutter further comprising:

a plurality of solid slats having parallel horizontal axes, said slats being movable in an upward and a downward direction in the guide rails by being wound up or down on the rotatable shaft, each slat having an upper edge with a hook-shaped connector and a lower edge with a hook-shaped connector, the upper and the lower hook-shaped connectors having openings facing in opposite directions to effect engagement of the connectors on the upper edge of each slat with the connectors on the lower edge of the slat positioned thereabove when said slats are in position to be raised, thereby holding all slats in a solid connection while the axes of the slats are at a maximum distance from each other, and permitting disengagement of said upper and lower connectors by turning of said slats about the axes thereof, upon complete lowering of said shutter onto a lower abutment surface of the opening, while the axes of the slats are at a minimum distance from each other, and whereof each slat is provided with a flat lug at each of two ends thereof, a plurality of rotatable rotors rotatably mountable in at least one of said guide rails at said minimum distance one above the other, each said rotor having a slot of a size permitting one said lug to slide into said slot, said rotors being aligned with said slots in a straight line, permitting said lugs to pass through all the slots during lowering or raising of said shutter, and means for simultaneous turning of all the rotors in one direction while said shutter is in the completely lowered position, effecting said connectors to disengage and all said slats to simultaneously turn about the same angle of inclination.

2. The roller shutter of claim 1, wherein solid grooved blocks are provided between each two said rotors, with said grooves in continuation of said slots in said rotors for smoothly guiding said lugs and said slats in the upwards and downwards direction.

3. The roller shutter of claim 2, wherein said grooves between each two rotors are in the form of grooves cut into said blocks.

4. The roller shutter of claim 1, wherein said hook-shaped connectors are formed by upper and lower edges of said slats bent backwards into a hook-shaped cross section.

5. The roller shutter of claim 1, wherein each said slat terminates short off said guide rails and is provided with a lateral member at each end which contains said lug and is provided with interengaging hook-shaped connectors of a kind preventing sideways disengagement.

6. The roller shutter of claim 5, wherein said lateral members are rigidly connected to the ends of each said slat and wherein each said member is releasably linked to the adjoining member by a hammer-shaped lug at an upper end thereat engaging with two loops at a lower end of the adjoining member.

7. The roller shutter of claim 5, wherein each said lateral member is rotatably mounted at either end of each slat on a bolt rigidly connecting the end of said slat with said lug, and is pivotally connected to an adjoining lateral member.

8. The roller shutter of claim 5, wherein said lateral member is made of aluminum.

9. The roller shutter of claim 5, wherein said lateral members are made of plastic material.

10. The roller shutter of claim 1, wherein said guide rails are in the shape of channels having a double bottom and flanges extending towards said slats.

11. The roller shutter of claim 1, wherein each said rotor is provided with a pin concentrically extending from the side opposite a slot into a bore in said bottom of said guide rail permitting its rotary movement.

12. The roller shutter of claim 1, wherein said rotors are pivotally attached to a bar vertically movable outside of said guide rail, connection being by means of levers extending from said rotors through slots in said guide rails and pivotally attached to said bar in spaced apart location, whereby vertical motion of said bar effects simultaneous turning of all said rotors about an identical angle.

13. The roller shutter of claim 1, wherein said rotors are pivotally attached to a bar vertically movable inside said guide rail, connection between each rotor and said bar being made by a lever integral with said rotor and pivotally attached to said bar.

14. The roller shutter of claim 1, wherein each said rotor is at least partly surrounded by a rim preventing sliding of said lugs out of said slots in said rotors.

15. The roller shutter of claim 14, wherein said rims are formed by blocks firmly attached to said guide rails and provided with cut-outs in the shape of said rotors.

16. The roller shutter of claim 12, wherein said grooves between each two rotors are in the form of grooves cut into said blocks.

17. The roller shutter of claim 1, wherein each said slat is hollow and is manufactured by extrusion.

18. The roller shutter of claim 17, wherein said slats are made of extruded aluminum.

19. The roller shutter of claim 17, wherein said slats are made of extruded elastic material.

* * * * *